US008430482B2

(12) United States Patent
Fang et al.

(10) Patent No.: US 8,430,482 B2
(45) Date of Patent: Apr. 30, 2013

(54) SINGULATING EJECTION CHIPS FOR MICRO-FLUID APPLICATIONS

(75) Inventors: Jiandong Fang, Lexnigton, KY (US); Carl Edmond Sullivan, Stamping Ground, KY (US); Richard E. Corley, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 212 days.

(21) Appl. No.: 12/893,124

(22) Filed: Sep. 29, 2010

(65) Prior Publication Data

US 2012/0075383 A1 Mar. 29, 2012

(51) Int. Cl.
*B41J 2/14* (2006.01)
*B41J 2/16* (2006.01)

(52) U.S. Cl.
USPC ..... 347/49; 347/42

(58) Field of Classification Search ..... 347/40–43, 347/47, 49; 29/25.35, 825, 890.1, 890.01
See application file for complete search history.

(56) References Cited

U.S. PATENT DOCUMENTS

| | | | | |
|---|---|---|---|---|
| 5,501,893 | A | 3/1996 | Laermer | |
| 5,650,075 | A | 7/1997 | Haas | |
| 6,136,668 | A | 10/2000 | Tamaki | |
| 6,174,789 | B1 | 1/2001 | Tsukada | |
| 6,184,063 | B1 | 2/2001 | McKenna | |
| 6,294,439 | B1 | 9/2001 | Sasaki | |
| 6,527,965 | B1 * | 3/2003 | Gee et al. | 216/24 |
| 7,078,267 | B2 | 7/2006 | Jiang | |
| 7,129,114 | B2 | 10/2006 | Akram | |
| 7,244,664 | B2 | 7/2007 | Blair | |
| 7,335,576 | B2 | 2/2008 | David | |
| 7,357,694 | B2 | 4/2008 | Popescu | |
| 7,498,238 | B2 | 3/2009 | Tamura | |
| 7,781,310 | B2 | 8/2010 | Grivna | |
| 2006/0068567 | A1 | 3/2006 | Beyne | |
| 2007/0087524 | A1 | 4/2007 | Montgomery | |
| 2009/0203192 | A1 | 8/2009 | Kaltalioglu | |

OTHER PUBLICATIONS

"Memjet Printhead", www.memjetwideformat.com/technology/printhead/, 3pp, printed Sep. 28, 2010.

* cited by examiner

*Primary Examiner* — Thinh Nguyen

(57) ABSTRACT

A micro-fluid ejection head has multiple ejection chips joined adjacently to create a lengthy array across a media to-be-imaged. The chips have fluid firing elements arranged to seamlessly stitch together fluid ejections from adjacent chips. Each chip aligns with other chips at peripheral regions having edge tolerances closer than elsewhere along the periphery. The tolerances result from both etching and dicing during chip singulation. Etching occurs at the areas of alignment. Dicing occurs elsewhere. Etching techniques include deep reactive ion etching or wet etching. It cuts a planar periphery through an entire thickness of the wafer. The etching may also occur simultaneously with etching a fluid via. Dicing techniques include blade, laser or ion beam. It cuts an entire remainder of the periphery connecting the portions already etched to free single chips from the wafer. Edge tolerances, planar shapes, dicing lines, etch patterns, and wafer layout provide still further embodiments.

19 Claims, 3 Drawing Sheets

SINGULATING EJECTION CHIPS FOR MICRO-FLUID APPLICATIONS

FIELD OF THE INVENTION

The present invention relates to micro-fluid ejection devices, such as inkjet printers. More particularly, although not exclusively, it relates to ejection heads having multiple ejection chips joined adjacently to create a lengthy micro-fluid ejection array or print swath. Singulation of chips from wafers facilitates certain designs. Etching and dicing techniques delineate edge tolerances, planar shapes, dicing lines, and etch patterns, to name a few. Wafer layout provides still further embodiments.

BACKGROUND OF THE INVENTION

The art of printing images with micro-fluid technology is relatively well known. A permanent or semi-permanent ejection head has access to a local or remote supply of fluid. The fluid ejects from an ejection zone to a print media in a pattern of pixels corresponding to images being printed. Over time, the fluid drops ejected from heads have become increasingly smaller to increase print resolution. Multiple ejection chips joined together are also known to make lengthy arrays, such as in page-wide printheads.

Fluid ejections near boundaries of adjacent chips have been known to cause problems of image "stitching." Registration needs to occur between fluid drops from adjacent firing elements, but getting them stitched together is difficult when firing elements reside on different substrates. Also, challenges to stitching increase as arrays grow into page-wide dimensions, or larger. While some designs have layouts intending to accommodate stitching, they have been observed to complicate chip fabrication. They introduce firing elements near terminal ends of chips to align lengthwise with colors shifted laterally by one fluid via on same or adjacent chips. They also reside on complexly shaped substrates.

In other designs, narrow print zones tend to favor narrow ejection chips. On opposing chips, adjacent fluid vias having a same fluid color demand exceptionally short distances in page-wide arrays to achieve high quality imaging. Simply moving adjacent chips closer to one another to narrow the print zone has inherent limitations in how closely the chips can be aligned. If chips are singulated from wafers by dicing, scribe lines introduce dicing streets widths of several tens of microns. Dicing along the streets leaves imperfect edges that prohibit fitting chips next to one another any closer than the several tens of microns dictated during scribing. While results vary from one technique to the next, none provide relief in making distances measurably shorter. Dicing also subjects the chips to considerable chipping and cracking damage along its sidewalls, especially in corner regions. The damage can cause elevated failure rates during later handling and subsequent assembly.

A need exists to significantly improve conventional ejection chip designs for larger stitched arrays. The need extends not only to improving stitching, but to manufacturing, handling and subsequent assembly. Additional benefits and alternatives are also sought when devising solutions.

SUMMARY OF THE INVENTION

The above-mentioned and other problems become solved with singulation techniques for ejection chips. Methods and apparatus include singulating ones of chips from larger wafers with both etching and mechanical dicing. The etching leaves chip edges with sub-micron precision, while the dicing leaves areas with less precision and poorer tolerance. The etched edges define regions where adjacent chips are aligned together in an array. They minimize distances between chips. The diced edges define regions where adjacent chips do not meet one another in the array.

In a representative embodiment, a micro-fluid ejection head has multiple ejection chips joined adjacently to create a lengthy array across a media to-be-imaged. The chips have fluid firing elements arranged to seamlessly stitch together fluid ejections from adjacent chips. Each chip aligns with other chips at peripheral regions having edge tolerances more precise than elsewhere along the periphery. During singulation, etching occurs at the areas of alignment. Dicing occurs elsewhere. Etching techniques include deep reactive ion etching or wet etching. It cuts a planar periphery through an entire thickness of the wafer. The etching optionally occurs simultaneously with etching a fluid via to save steps and processing costs. The etching can also occur at the wafer level before or after photo-imaging processes to make nozzle plates for the many chips. Dicing techniques include blade, laser or focused ion beam. It cuts an entire remainder of the periphery to free single chips from the wafer.

Edge tolerances, planar shapes, dicing lines, etch patterns, and wafer layout provide still further embodiments. Representative examples include substantially rectangular chips having two long and short ends. The long ends substantially parallel one another and the length of the array. Corner regions of the chips are etched. Dicing occurs elsewhere. The corner regions define areas of alignment between the chips in the array. The etching shortens a distance between the chips as well as distances between same color fluid vias on adjacent chips. A first corner region along one long end from one chip and a second corner region along a second long end from another chip define a parallel gap between two chips in the array. A separation distance of about 10-20 μm exists in a direction of media advance transverse to the direction of the array. This improves conventional designs having gaps of 70 μm or more.

These and other embodiments are set forth in the description below. Their advantages and features will be readily apparent to skilled artisans. The claims set forth particular limitations.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE ILLUSTRATED EMBODIMENTS

In the following detailed description, reference is made to the accompanying drawings where like numerals represent like details. The embodiments are described in sufficient detail to enable those skilled in the art to practice the invention. It is to be understood that other embodiments may be utilized and that process, electrical, and mechanical changes, etc., may be made without departing from the scope of the invention. Also, the term wafer or chip includes any base semiconductor structure, such as silicon-on-sapphire (SOS) technology, silicon-on-insulator (SOI) technology, thin film transistor (TFT) technology, doped and undoped semiconductors, epitaxial layers of silicon supported by a base semiconductor structure, as well as other semiconductor structures hereafter devised or already known in the art. The following detailed description, therefore, is not to be taken in a limiting sense and the scope of the invention is defined only by the appended claims and their equivalents. In accordance with the present invention, methods and apparatus include singulating ejection chips for a micro-fluid ejection head, such as an inkjet printhead.

Figure 1:
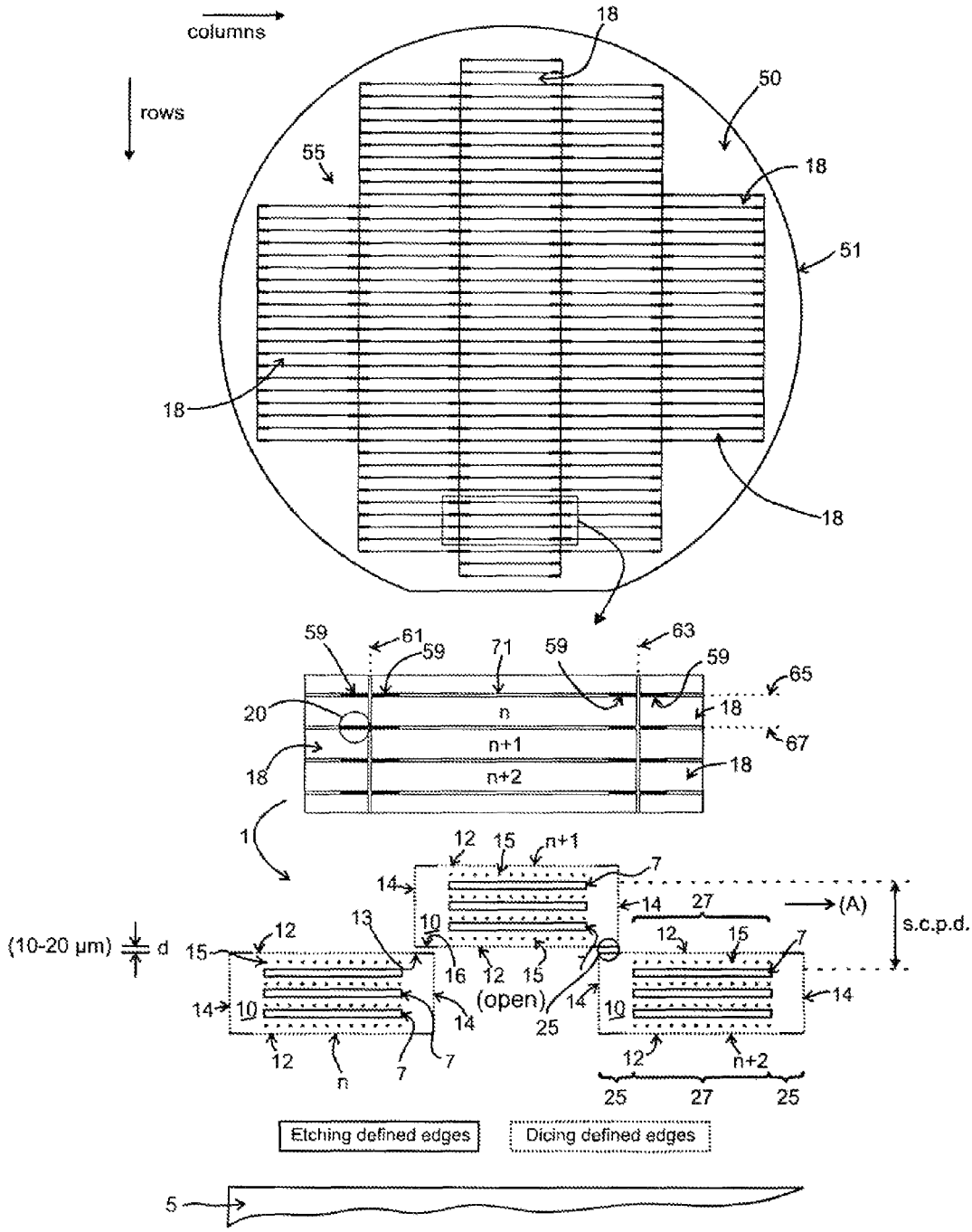
FIGS. 1 and 2 are diagrammatic views in accordance with the present invention showing wafers and chip singulation with etching and dicing configurable in arrays.

With reference to FIG. 1, plural ejection chips n, n+1, n+2 . . . are configured adjacently in a direction (A) across a media to-be-imaged 5. The micro-fluid array 1 includes as few as two chips, but as many as necessary to form a complete array. The array typifies variability in length, but two inches or more are common distances depending upon application. Arrays of 8.5" or more are contemplated for imaging page-wide media in a single printing pass. The arrays can be used in micro-fluid ejection devices, e.g., printers, copiers, medical devices, etc., having either stationary or scanning ejection heads. The media advances past the chips in an imaging device in a direction transverse to the array length. A circuit board or frame (not shown) may be used to commonly mount the chips.

Each chip includes pluralities of fluid firing elements 15. The elements are any of a variety, but contemplate resistive heaters, piezoelectric transducers, or the like. They are formed on the chip through a series of growth, patterning, deposition, evaporation, sputtering, photolithography or other techniques. They have spacing along an ink via 7 to eject fluid from the chip at times pursuant to commands of a printer microprocessor or other controller. The timing corresponds to a pattern of pixels of the image being printed on the media. The color of fluid corresponds to the source of ink, such as cyan, magenta, yellow, or black.

The planar shape 10 of the chip typifies a rectangle. It has two parallel long ends 12 and two parallel short ends 14. Adjacent long and short ends connect together in a corner region 20. Corner regions of the chips are etched, while dicing occurs elsewhere. The corner regions define areas of alignment between the chips in the array. The etching shortens a distance (d) between the chips as well as distances between same color fluid vias on adjacent chips (s.c.p.d. "same color plane distance"). In the given design, a first corner region 13 along one long end 12 from one chip n and a second corner region 16 along a second long end 12 from another chip n+1 define a parallel gap between two chips in the array. A separation distance of about 10-20 μm exists in a direction of media advance transverse to the direction of the array. This improves conventional designs having gaps of 70-250 μm or more.

Also in this region, each chip aligns with another chip at peripheral areas 25 having edge tolerances more precise than elsewhere 27 along the same periphery. The design enables chips to only face one another in regions of close tolerance and elsewhere can extend slightly with poorer tolerance into the "open" area thereby freeing constraints during alignment. No longer do the diced edges of the chip set an artificial constraint on how closely chips can be arranged. Rather, the etched portions define closeness of the chips.

To achieve singulation, a wafer 50 includes pluralities of ejection chips 18. The chips are patterned in a grid 55 defined by pluralities of rows and columns. Some chips have neighboring chips above and below and on their left and right. Other chips have fewer neighbors, such as near a terminal boundary 51. The layout stacks as many chips as possible per the size constraints of the wafer relative to the size of the ejection chips. A representative wafer size is about four to eighteen inches in diameter with a thickness ranging from about 200 to 900 microns. The ejection chips have representative lengths and widths of about 0.2"-1.2" and 0.8 mm-10 mm, respectively. Also, the wafer typifies a <100> orientation of p-type having a resistivity of 5-20 ohm/cm. Other wafers are possible.

Figure 3:
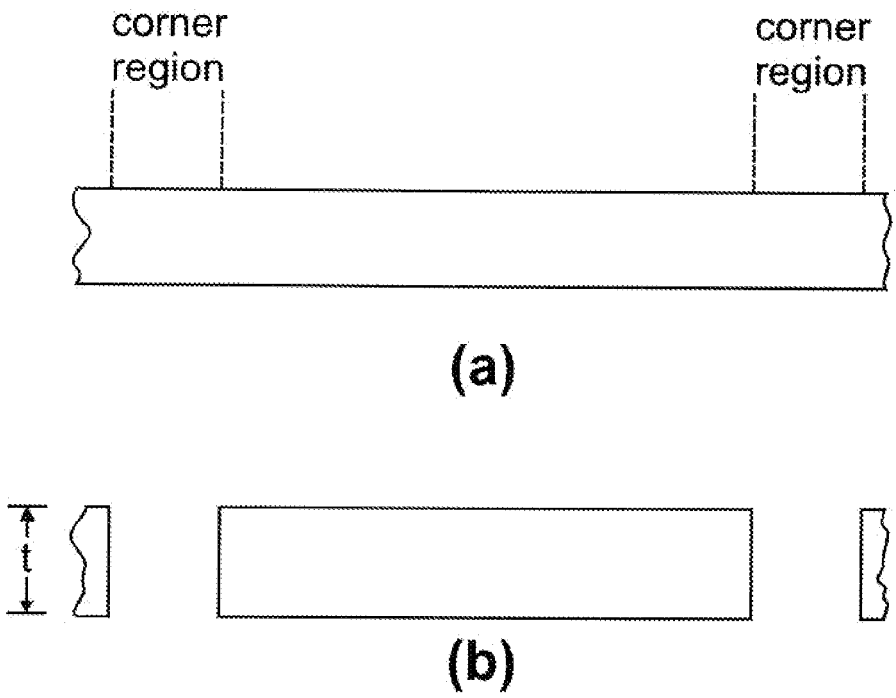
FIGS. 3*a* and 3*b* are cross sections of ejections chips.

Rectangular shapes of chips 18 are repeatedly achieved with traditional stepper exposures. The corner regions of each chip are etched (solid lines) by DRIE (deep reactive ion etching), wet etching, or other processes to achieve tight tolerance along the chip edges to beget close fitting with other chips in an array. The etching occurs through an entire thickness t of the wafer substantially transverse to the planar periphery (FIG. 3). It may occur at a same time, or not, as an etching of the fluid vias in the chip. Thereafter, the entire remainder of the periphery is mechanically diced (dashed lines). The dicing connects the portions of the periphery already etched to free from the wafer singular ones of the ejection chips. The dicing can include blade, laser, focused ion beam or other. In the design shown, etching occurs along only the terminal ends 59 of the long ends 12 of the chips. Dicing occurs elsewhere along the entirety of vertical streets 61, 63 and along the horizontal streets 65, 67 at other 71 than the terminal ends 59 of the long ends in the corner region. Knowing in advance where the chips will require alignment in the array, skilled artisans are able to set particular patterns for etching.

Figure 2:
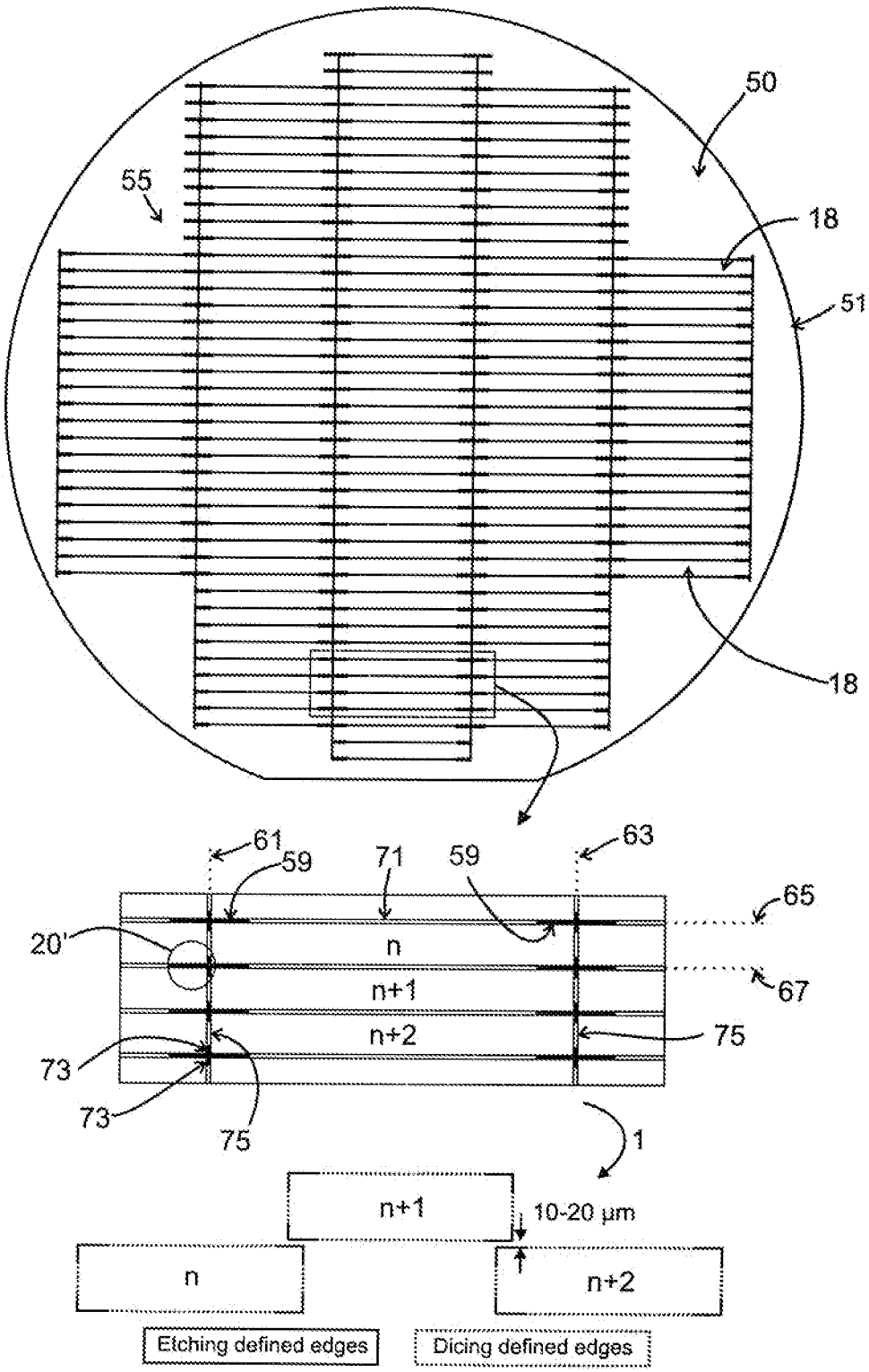

With reference to FIG. 2, etching and dicing of the wafer 50 occurs with a pattern in the corner region 20' slightly different than that of FIG. 1. In this embodiment, etching occurs through a thickness of the wafer in both vertical and horizontal directions. It includes the terminal ends 59 of the long ends 12 of the chips, as before, as well as portions 73 of the vertical streets. The terminal ends 59 and the portion 73 meet at an absolute corner of the chip periphery and extend from there in both the horizontal and vertical directions. The length of the etching can range from about 0.5 to about 5.0 mm, depending upon a relative size of the chip. Dicing occurs elsewhere along the remainder of the vertical streets 61, 63 at position 75 and along the horizontal streets 65, 67 at other 71 than the terminal ends 59 of the long ends. The portions of the wafer that remain after etching can facilitate parts handling, for example.

Figure 4:
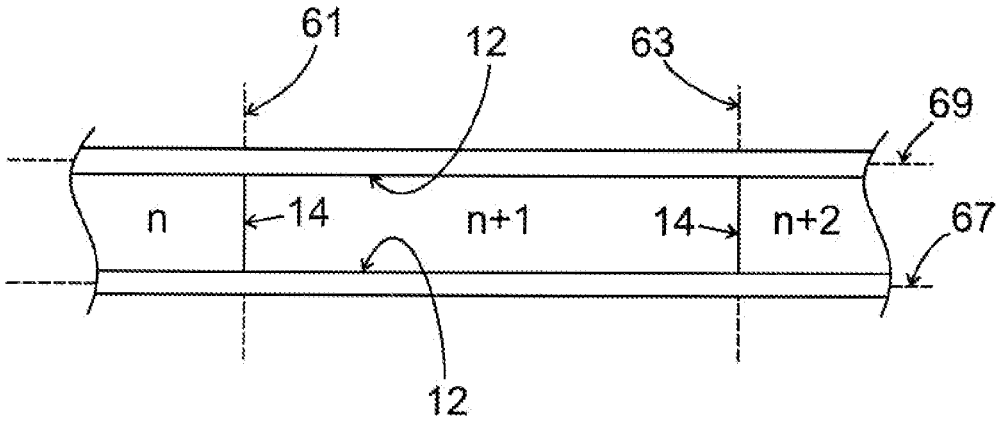
FIG. 4 is a diagrammatic view of an alternate chip singulation technique having etching and dicing.

In still other embodiments, FIG. 4 shows that etching can occur through a thickness of a wafer along an entirety of the horizontal streets 65, 67. Dicing then occurs in the mutually exclusive vertical direction along streets 61, 63. In this manner, areas of future alignment of ejection chips in an array can reside anywhere along the two longs ends of the rectangular chips. Nowhere do limits exist on how closely chips can move laterally toward one another along the length of the array. Rather, chips are only limited in alignment as the short ends 14 of adjacent chips approach one another in the array. The design also facilitates only needing to establish dicing patterns in one dimension. It saves processing time.

Relatively apparent advantages of the many embodiments include, but are not limited to: (1) rectangular chips having very closely positioned fluid vias of a same color for use in lengthy arrays; (2) chips facilitating assembly closer to other chips than previous generations; (3) chips having fewer cracks in fragile areas, such as in corner regions; and (4) high-yield wafers having relatively cost effective manufacturing.

The foregoing illustrates various aspects of the invention. It is not intended to be exhaustive. Rather, it is chosen to provide the best illustration of the principles of the invention and its practical application to enable one of ordinary skill in the art to utilize the invention, including its various modifications that naturally follow. All such modifications and variations are contemplated within the scope of the invention as determined by the appended claims. Relatively apparent modifications include combining one or more features of various embodiments with one another.

The invention claimed is:

1. A method of singulating ones of a plurality of ejection chips from a wafer, comprising:

etching a portion of a planar periphery of said ones of the ejection chips through an entire thickness of the wafer substantially transverse to the planar periphery, further including etching only a corner region of the planar periphery; and dicing an entire remainder of the planar periphery connecting the portions said etched to free from said wafer said ones of the ejection chips.

2. The method of claim 1, wherein the etching only the corner region includes etching two adjacent sides of said ones of the ejection chips having a substantially rectangular planar orientation.

3. The method of claim 1, further including etching an entire length of the planar periphery of said ones of the ejection chips.

4. The method of claim 3, further including dicing a width of the planar periphery between adjacent said corner regions of said ones of the ejection chips.

5. The method of claim 1, the planar periphery defining a substantially rectangular shape having two long and short ends, further including etching each of the two short ends but leaving portions of the wafer for said dicing on said each of the two short ends.

6. The method of claim 1, the planar periphery defining a substantially rectangular shape having two long and short ends, further including etching each of the two long ends but leaving portions of the wafer for said dicing on said each of the two long ends.

7. The method of claim 1, further including etching with deep reactive ion etching or wet etching.

8. The method of claim 1, further including dicing with blade dicing, laser dicing or ion beam dicing.

9. The method of claim 1, further including etching a fluid via in an interior of said planar periphery through the thickness of the wafer at a same time as said etching the planar periphery of said ones of the ejection chips.

10. A method of singulating ones of a plurality of ejection chips from a wafer, comprising:

etching a portion of a planar periphery of said ones of the ejection chips through an entire thickness of the wafer substantially transverse to the planar periphery; and dicing an entire remainder of the planar periphery connecting the portions said etched to free from said wafer said ones of the ejection chips, further including determining an area of future alignment of said ones of the ejection chips to others of said ejection chips, the etching occurring substantially only at the determined said area of future alignment.

11. The method of claim 10, further including aligning together in a lengthy imaging array said ones and said others of said ejection chips at said defined area of future alignment.

12. A method of singulating ones of plural ejection chips from a wafer, comprising:

defining an area of future alignment of said ones of the ejection chips to others of said ejection chips; and etching a periphery of said ones of the ejection chips through an entire thickness of the wafer at said defined area of future alignment, elsewhere dicing said periphery of said ones of the ejection chips.

13. The method of claim 12, wherein said dicing and said etching further include dicing and etching in mutually exclusive lateral dimensions across said wafer.

14. The method of claim 12, wherein said etching the periphery further includes etching a corner region of said ones of the ejection chips.

15. The method of claim 14, wherein the etching the corner region includes etching two adjacent sides of said ones of the ejection chips having a substantially rectangular planar orientation.

16. The method of claim 12, further including etching with deep reactive ion etching or wet etching.

17. The method of claim 12, further including dicing with blade dicing, laser dicing or ion beam dicing.

18. The method of claim 12, further including aligning together in a lengthy imaging array said ones and said others of said ejection chips at said defined area of future alignment.

19. The method of claim 12, further including etching a fluid via in an interior of said periphery through the thickness of the wafer at a same time as said etching the periphery of said ones of the ejection chips.

* * * * *